US009745842B2

(12) United States Patent
Jain

(10) Patent No.: US 9,745,842 B2
(45) Date of Patent: Aug. 29, 2017

(54) PROXIMITY CALCULATION IN A GEOSCIENCE DOMAIN

(71) Applicant: SCHLUMBERGER TECHNOLOGY CORPORATION, Sugar Land, TX (US)

(72) Inventor: Vivek Jain, Mumbai (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 478 days.

(21) Appl. No.: 14/535,054

(22) Filed: Nov. 6, 2014

(65) Prior Publication Data

US 2015/0167433 A1 Jun. 18, 2015

Related U.S. Application Data

(60) Provisional application No. 61/917,771, filed on Dec. 18, 2013.

(51) Int. Cl.

| | |
|---|---|
| ***G06G 7/48*** | (2006.01) |
| ***E21B 43/30*** | (2006.01) |
| ***E21B 43/12*** | (2006.01) |
| ***E21B 43/00*** | (2006.01) |

(52) U.S. Cl.

CPC ..... *E21B 43/305* (2013.01); *E21B 43/00* (2013.01); *E21B 43/12* (2013.01)

(58) Field of Classification Search

CPC ..... E21B 43/00; E21B 7/00; E21B 43/305; E21B 43/2408; E21B 43/12; E21B 7/04; E21B 44/00

See application file for complete search history.

(56) References Cited

U.S. PATENT DOCUMENTS

| | | | | |
|---|---|---|---|---|
| 7,878,268 | B2 * | 2/2011 | Chapman | E21B 7/00 175/24 |
| 2004/0015795 | A1 | 1/2004 | Frank et al. | |
| 2007/0088530 | A1 | 4/2007 | Erignac et al. | |
| 2010/0084191 | A1 * | 4/2010 | Chapman | E21B 44/00 175/24 |
| 2012/0273205 | A1 * | 11/2012 | Metcalfe | E21B 43/12 166/306 |

(Continued)

FOREIGN PATENT DOCUMENTS

WO 2010053618 A1 5/2010

OTHER PUBLICATIONS

International Search Report and Written Opinion issued in PCT/US2014/068145 on Mar. 25, 2015, 14 pages.

*Primary Examiner* — Kandasamy Thangavelu

(57) ABSTRACT

Systems, methods, and computer-readable media for planning a well are provided. The method includes defining a well in a representation of a domain, and identifying an offset well in the domain that is within a threshold distance of the well. The method also includes deconstructing the offset well into a plurality of offset bases, and determining that a first offset base of the plurality of offset bases is within the threshold distance of the well. The method further includes determining that a second offset base of the plurality of offset bases is not within the threshold distance of the well, and performing a proximity computation for the well with respect to the first offset base but not the second offset base.

20 Claims, 4 Drawing Sheets

(56) References Cited

U.S. PATENT DOCUMENTS

| | | | | |
|---|---|---|---|---|
| 2013/0000898 | A1* | 1/2013 | Boone | E21B 43/2408 166/272.7 |
| 2013/0043025 | A1* | 2/2013 | Scott | E21B 43/305 166/276 |
| 2013/0140037 | A1 | 6/2013 | Sequeira et al. | |
| 2013/0140088 | A1* | 6/2013 | Williams | E21B 7/04 175/45 |
| 2013/0146285 | A1* | 6/2013 | Chhina | E21B 43/00 166/268 |
| 2013/0191081 | A1 | 7/2013 | Jain et al. | |

* cited by examiner

PROXIMITY CALCULATION IN A GEOSCIENCE DOMAIN

RELATED APPLICATIONS

This application claims priority to and the benefit of U.S. Provisional Patent Application No. 61/917,771, filed 18 Dec. 2013, which is incorporated by reference herein.

BACKGROUND

"Well planning" is the process of mapping the shape and trajectory of a path for a well prior to or during drilling, so as to reach or intersect one or more targets in an efficient manner while maximizing the likelihood of success. Drilling hardware and techniques allow for steering of the drill string to generally match the desired path, subject to limiting physical factors. Thus, the drilling operators are able to follow the well plan, which may range in shape from simple (e.g., a vertical well) to complex.

To plan a suitable path, a variety of modeling interfaces and engines are available. Generally, a target (e.g., a reservoir) is identified and one or more well paths are plotted that extend through discretized points positioned between the surface and the target. The modeling engines may begin with one or more templates or "bases" for the well plan that provide a geometric shape representing the path the wellbore takes, e.g., to reach the target. A single well plan may include one basis or several bases, which form the overall profile of the well plan.

A variety of factors may influence well planning. For example, it may be advantageous or required to maintain at least a certain distance between the subject well and features in the surrounding domain. Such features may include other wells ("offset wells"), geological features that may present difficulties in wellbore construction, etc. Other features may be targets for the well, and thus it may be advantageous or required to intersect these features with the well. Accordingly, well planning platforms may track the proximity of such features to the well, so as to avoid or ensure that the wellbore intersects the features. However, such proximity calculations may be computation-intensive, especially when editing (i.e., changing the shape/location of) the subject well in the well plan, which may inhibit rapidly displaying changes.

SUMMARY

Systems, methods, and computer-readable media are provided herein that facilitate well planning. In an embodiment, such a method generally begins by, as a first "pass," identifying offset wells and features that are of interest to a subject well (i.e., a well being planned) in a representation of a domain. For example, the offset wells/features of interest may be identified by their distance from the well, or a portion thereof. The method may then undertake a second identification "pass" through the features that were previously identified. In this second pass, the offset wells (and/or features) may be deconstructed into bases (e.g., discretized segments/portions) that are used for a proximity analysis. An uncertainty in the position of the well and/or the offset features may also be taken into consideration in the proximity analysis by employing envelopes or bounding boxes around the features, which may each represent a zone of uncertainty where the associated features/wells could be located.

The proximity analysis may then be performed between the envelopes of the subject well and the offset features/wells of interest. The proximity computation proceeds for the subject and/or offset bases that meet the proximity analysis criteria, while the method generally refrains from conducting the proximity calculation for bases that do not meet the initial proximity analysis criteria. Additionally, the method may include storing the information determined (identity of wells, bases, features of interest, distances, etc.) for subsequent computations are highly speeded up. Moreover, various aspects of this method may facilitate parallelization of the computations.

These and other aspects of the disclosure will be described in greater detail below. Accordingly, it will be appreciated that the foregoing summary is intended merely to introduce a subset of the aspects described below and is, therefore, not to be considered limiting on the present disclosure.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
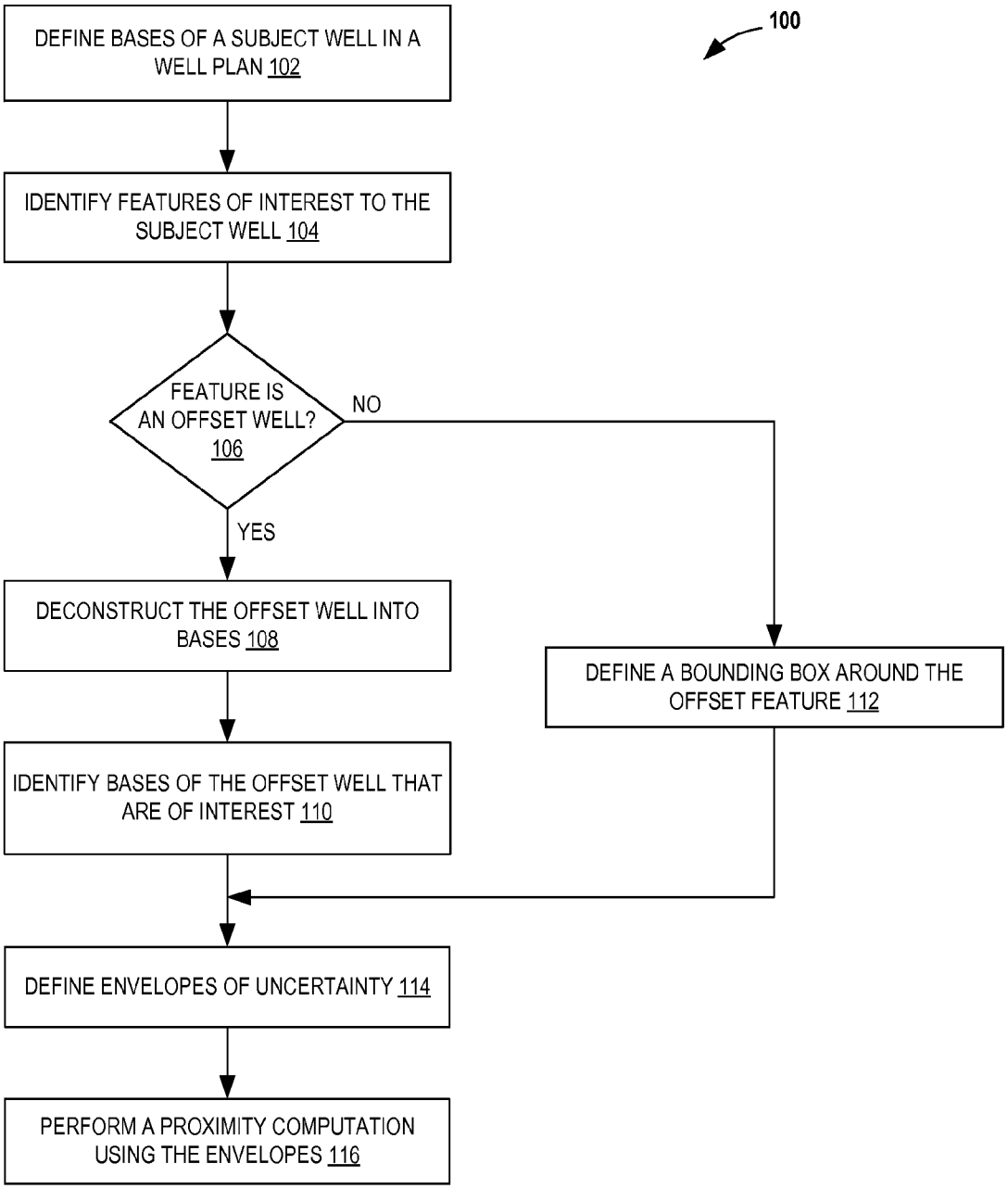
FIG. 1 illustrates a flowchart of a method for proximity calculation in a well plan, according to an embodiment.

The following detailed description refers to the accompanying drawings. Wherever convenient, the same reference numbers are used in the drawings and the following description to refer to the same or similar parts. While several embodiments and features of the present disclosure are described herein, modifications, adaptations, and other implementations are possible, without departing from the spirit and scope of the present disclosure.

Figure 2:
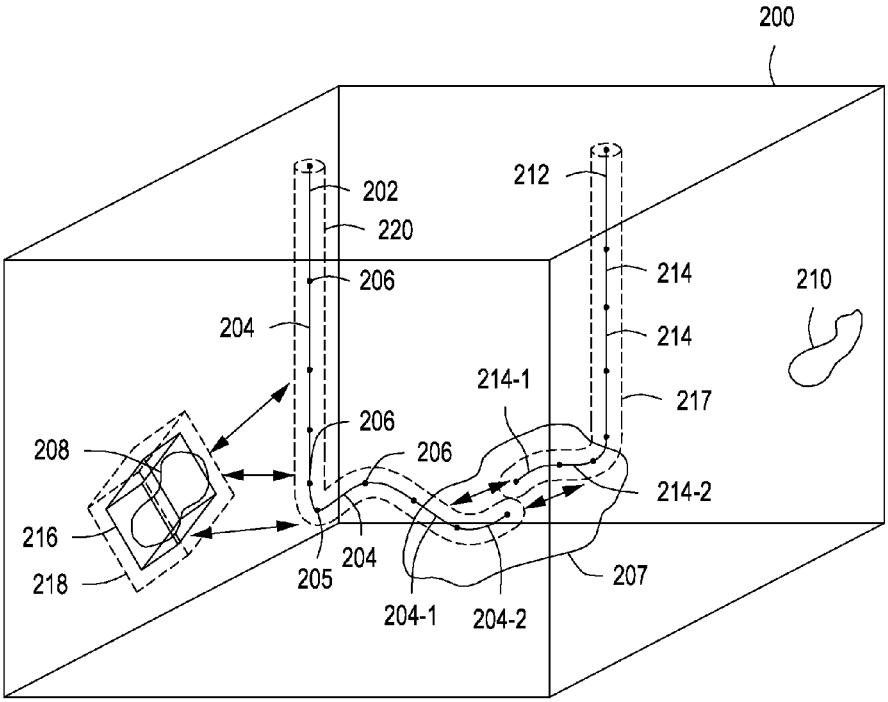
FIG. 2 illustrates a simplified view of a representation of a subterranean domain, according to an embodiment.

FIG. 1 illustrates a flowchart of a method 100 for determining proximity in a well plan, according to an embodiment. FIG. 2 illustrates a simplified view of a subterranean, geological domain 200, including a well plan for a "subject" well 202, according to an embodiment. The "subject" well 202 may be the well 202 that is currently being considered, e.g., as selected by a user, automatically, etc. Referring now to FIGS. 1 and 2, the method 100 may begin by defining the well 202 in the domain 200, as at 102. The well 202 may be provided as a series of "bases" 204, i.e., discrete sections of the well 202 that are linked together to define the continuous path from an originating point (e.g., at the surface) to a target 207 (e.g., a reservoir). This continuous path may represent the well plan for the well 202.

The bases 204 may be used to construct the well 202 in the domain 202. For example, a library of predefined base shapes may be provided, from which the bases 204 may be selected (e.g., by a user or automatically) so as to define the well 202. In another embodiment, the user may employ a more "free-form" process of drawing the well 202, which thereafter may be deconstructed into a plurality of bases 204.

In other embodiments, any other suitable process for defining the bases 204 may be employed.

The bases 204 may each be defined between end points 206, which may be connected together such that adjacent bases 204 share an end point 206. Further, the bases 204 may include one or more intermediate points 205. The intermediate points 205 may define points of inflection or direction change in the base 204 of which they are a part. It will be appreciated that the bases 204 may have multiple different lengths, shapes, etc., whether predefined or based on a deconstruction of the well 202.

The method 100 may then proceed to identifying offset features of interest to the subject well 202, as at 104. The offset features identified at 102 may each be one of several possible types of features. One type of feature may be a geological feature 208, 210. Another feature may be an offset well 212. Accordingly, identifying at 102 may proceed by considering features within the domain 200 and then deciding whether they pose a potential hazard sufficient to warrant additional analysis.

In an embodiment, identifying offset features of interest at 102 may include, for example, determining whether one or more features 208-212 are within a threshold distance of the subject well 202. The threshold distance may be uniform or may vary according to a variety of factors, for example, the type of offset feature, depth, faults, rock structure, other geological considerations, etc., to name just a few among many contemplated. Moreover, in other embodiments, other considerations apart from the distance may be considered in identifying at 102. The threshold distance may further be determined based on business considerations, risk tolerance, and the like.

In the example illustrated in FIG. 2, the geological feature 208 and the offset well 212 may be considered to be of interest, e.g., based on proximity to the well 202. In contrast, the geological feature 210 may be sufficiently far away from the well 202 that it is not considered to be of interest. Thus, the feature 210 may be excluded from further consideration in at least one iteration of the method 100.

Still considering the example of FIG. 2 and referring again to the method 100 of FIG. 1, the method 100 may proceed to determining in what category each of the features 208, 212 identified as being of interest at 104 falls. For example, the method 100 may determine whether each of the features 208, 212 is an offset well or another type of feature (e.g., a geological feature), as at 106. In other embodiments, other categorizing determinations may instead or in addition be employed.

If the feature is an offset well, such as the offset well 212, the method 100 may proceed to deconstructing the offset well 212 into bases 214, as at 108. In some cases, the bases 214 may already be present in the system (i.e., in the stored representation of the offset well 212) and thus deconstructing at 108 may be conducted by accessing information about the bases 214 that may be pre-existing. For example, the offset well 212 may have been previously constructed as part of a well plan, i.e., it may have previously served as the subject well. In such case, the bases 214 that were employed to construct the offset well 212 may provide the bases 214. In another instance, the offset well 212 may not have served as the subject well previously and/or the bases from which it is constructed may not otherwise be provided. Whether already known or provided by analysis, such bases 214 may be provided as part of the deconstructing at 108.

The method 100 may then proceed to identifying which of the bases 214 are of interest to the subject well 202, as at 110. Like the identification at 104, the identification at 110 may proceed according to a proximity analysis. For example, each of the bases 214 may be considered, and the position thereof compared to the position of the subject well 202, so as to determine if the specific base 214 is of interest. Since, in at least one scenario, the offset well 212 has already been determined to be of interest, it may assumed that one, or possibly more than one, of the bases 214 is (are) also of interest. For example, the method 100 may perform the proximity analysis so as to determine whether and which of the bases 214 are within a threshold distance of the well 202. The threshold distance may be the same or different from the threshold distance applied during the identifying at 104. Further, the threshold distance may remain constant for each of the bases 214 or may change, for example, according to depth, geology, feature type, etc.

In one or more embodiments, the identification at 110 may include performing the proximity analysis as between each pair of bases 204 and 214 of the subject well 202 and the offset well 212, respectively. These distances between each pair may be stored for later use. In another embodiment, only the distances between the pairs of bases 204, 214 that fall under the threshold are saved. In other embodiments, the distance between the pairs of bases 204, 214 may not be saved; rather, a flag or other variable (binary or otherwise) may be set, indicating that the pair of bases 204, 214 are close enough together to be of interest. In another embodiment, the identification at 110 may proceed by determining the distance between each of the bases 214 to any point along the well 202, to determine whether the base 214 is of interest in the offset well 212.

On the other hand, if the feature under consideration at 106 is not a well, it may, instead, be a geological feature such as the feature 208. In such case, the method 100 may proceed to defining a bounding box 216 around the offset feature 208, as at 112. The bounding box 216 may be generally rectilinear according to a preset shape. For example, the bounding box 216 may be a rectangular prism, as shown. In another embodiment, the bounding box 216 shape may be selected, e.g., automatically or by a user, such that it more closely conforms to the geometry of the feature 208. In yet another embodiment, the bounding box 216 may be formed from several different shapes, or may be formed by curves so as to conform to the geometry of the feature 208 (e.g., a "shrink wrap").

This sequence of determining at 106 and then either deconstructing at 108 and identifying at 110 or defining the bounding box 216 at 112, may proceed in parallel or in sequence for one, some, or all of the features of interest identified at 104. Further, this sequence may result in a reduced portion of the offset well 212 and/or of the subject well 202 remaining of interest for subsequent analysis. For example, the bases 214 of the offset well 212 that are not of interest to the well 202, or any base 204 thereof, may be discarded from further proximity consideration with respect to the subject well 202. However, for example, bases 214-1 and 214-2 may remain of interest as within the relevant distance threshold of the subject well 202, for example, bases 204-1 and 204-2 thereof, respectively.

Before, during, or after considering one, some, or each of the features identified at 104, as part of the sequence just discussed, the method 100 may proceed to defining envelopes of uncertainty 217, 218 around the remaining bases 214 and features 208 of interest, as at 114. The subject well 202 may also have an uncertainty associated therewith, and may thus also have an envelope 220 defined therearound. Accordingly, the envelopes 217-220 may allow the model to consider a "worst-case" scenario, in which the well 202 is positioned closer to offset well 212 or feature 208, while the offset well 212 or feature 208 is also shifted closer to the subject well 202.

In another implementation, an uncertainty envelope may be defined for some or all offset wells/features prior to performing a proximity analysis. The proximity analysis may then be performed, and may be more accurate. Once the uncertainty envelope has been added, the uncertainty envelope may be stored with the well/feature for use in subsequent operations.

The envelopes 217-220 may be cubes, for example, encompassing the well 202, 212 or features 208 in which they encompass. Cubic envelopes 216-220 may be simple, facilitating high-speed analysis. However, depending on the geometry of the well 202, 212 or features 208, such cubic (or prismatic) envelopes 216-220 may be larger than required and thus, in subsequent proximity and/or anti-collision analyses, may result in false positives. According, in some cases a "shrink wrap" envelope may be employed, which may conform closely to the shape of the well 202, 212 or feature 208 around which it is defined, while defining an uncertainty area of generally the same shape as, although larger than, the respective well 202, 212 or feature 208.

The method 100 may then proceed to undertaking a proximity computation between the envelopes 216-220, as at 116. The proximity computation at 116 may be a simple determination of distance and comparison thereof to a threshold. However, in other embodiments, the proximity computation at 116 may be more complex. For example, the proximity analysis at 116 may determine whether geomechanical stresses may develop that may present a risk to well integrity, as related to the proximity. Further, the proximity computation at 116 may suggest alternative routes or bases 204 for the subject well 202 and/or for the offset well 212, if possible, to avoid collision or proximity that is closer than considered tolerable.

The proximity computation between the well 202 and the feature 208 may also proceed for each base 204. Accordingly, the feature 208 may not be identified as being of interest to one or more of the bases 204; thus, the feature 208 may be ignored for those bases 204 during the computation. However, the feature 208 may be identified as being of interest to one or more others of the bases 204. The proximity of the feature 208 to these bases 204 may be considered for future analysis, the distance stored for later use, etc.

Aspects of the method 100 may proceed in parallel, for example, using a multi-threading processor or single core/multiple-core processors, as will be described in greater detail below. Additionally or alternatively, aspects of the method 100 may be distributed to different processors and/or different machines, locally or remotely. For example, the sequence of 106-112 may involve several independent calculations, e.g., for each individual feature of interest. Further, performing the proximity computation for the features of interest at 116 may be independent as between the envelopes 217, 218 of each pair of bases 204, 214; thus, two or more of such computations may be performed in parallel. Various other ways to separate aspects of the method 100 into parallel components will be apparent, and are contemplated herein.

Figure 3:
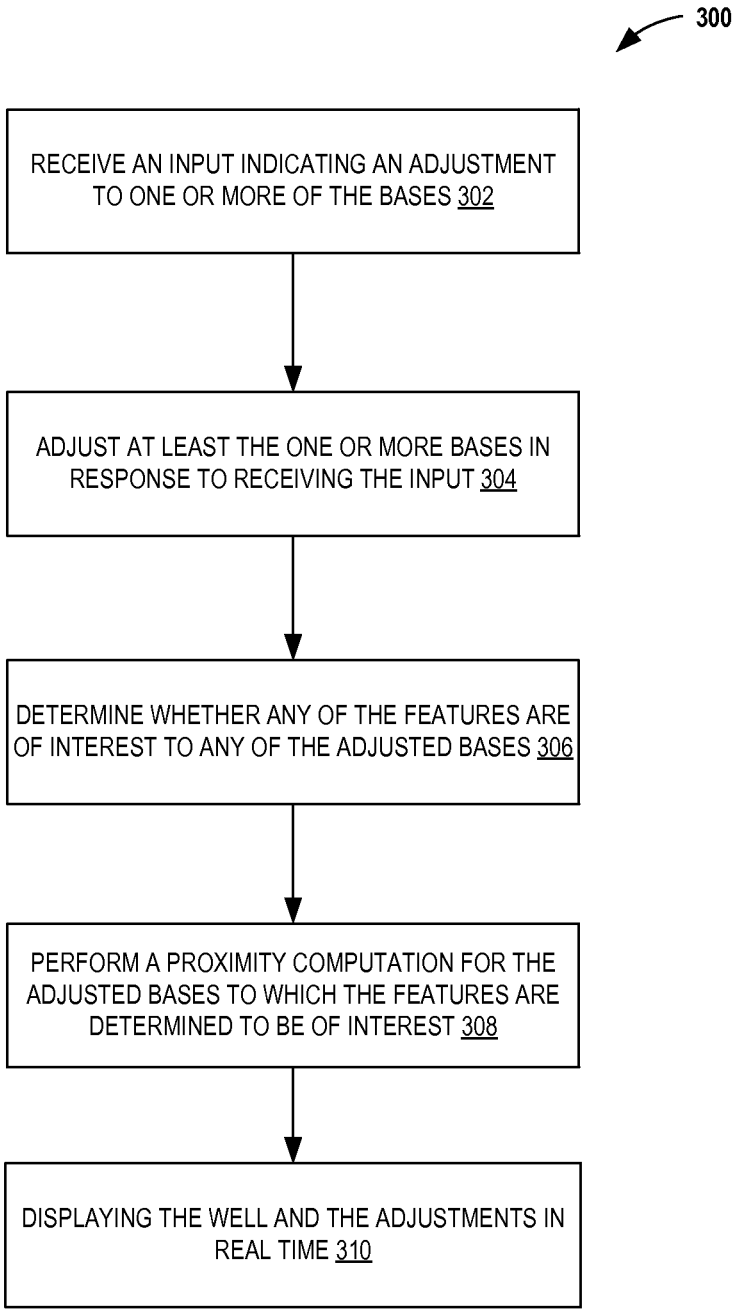
FIG. 3 illustrates a flowchart of a method for adjusting the well in the well plan, according to an embodiment.

The proximity analyses/computations for the bases 204, 214 and feature 208 may be stored for use in subsequent operations, such as when the geometry of the subject well 202 is modified. FIG. 3 illustrates a flowchart of a method 300 that may make use of such stored information, according to an embodiment and may be integrated into the method 100 of FIG. 1. In an embodiment, the method 300 may include receiving an input indicating an adjustment to one or more elements of the domain 200, as at 302, for example, a location, a shape, or a geological property of one or more of the feature 208, 210, the offset well 212 (e.g., one or more of the bases 214 thereof), and/or one or more of the bases 204 of the subject well 202. In another embodiment, the element being adjusted may be a physical property of the domain 200 or a portion thereof.

The input may be received from any type of device, for example, an input peripheral coupled with a computing system, as will be described in greater detail below. In some case, the domain 200 may be displayed in three-dimensions on a display of the computing system, and the input may represent a desire of a user to adjust a location of one or more of the bases 204. In the case where the element being adjusted is one of the bases 204, the user may provide such input by, for example, using a cursor to select one of the bases 204 and moving (e.g., "dragging") it to a new location. If the adjusted element is the offset well 212 and/or the features 208, 210 the adjustment input may be provided by the user, e.g., via such an input peripheral, or by receiving an update to the domain 200 representation, e.g., such as by receiving new seismographic information.

The method 300 may then proceed to adjusting at least the element that is the subject of the input, as at 304. If the element is the base 204 and/or the offset base 214, it will be appreciated that, to maintain continuity and in keeping with physical constraints, such adjustment thereto may result in one or more adjacent bases 204, 214, respectively, also being adjusted.

The method 300 may then include determining whether the adjustment to the adjusted base 204, feature 208, 210, and/or offset well 212 has resulted in the adjusted element being newly of interest to one or more of the base 204 to which it was not previously of interest, as at 306, and performing a proximity analysis in response, where needed, as at 308. In the case that the adjusted element is one or more of the bases 204, the method 100 may avoid re-performing the proximity analysis for all of the bases 204 by accessing stored information of the bases 204 that are not adjusted. Further, in some cases, the method 300 may include considering the bases 214 of the offset well 212 that were previously determined to be of interest to the bases 204 that are adjusted at 304. That is, the method 300 may allow avoiding the consideration of the entire length of the offset well 212 for proximity analysis with the adjusted bases 204; instead, the method 100 may allow the proximity calculations to be confined to those bases 214 of the offset well 212 that were previously considered to be of interest to the adjusted bases 204. In another embodiment, the method 300 may compute the change in the bases 204 being edited and then use that information to determine well bases/features of interest for computing or re-computing proximity analysis.

If the adjustment is to the features 208 and/or the offset well 212, the method 300 may perform similarly. For example, the method 300 may allow the proximity calculations to be confined to the bases 204 for which the adjusted feature 208 and/or offset well 212 were previously considered to be of interest. The method 300 may additionally check, e.g., adjacent or otherwise-related bases 204 to the bases 204 to which the adjusted feature 208 and/or offset well 212 were considered of interest, to determine if the adjustment has resulted in the adjusted element being of interest to other bases 204.

Various redundancies and other measures may be employed to ensure no new "of interest" bases 214, features 208, 210, etc. are overlooked for an adjusted element of the domain 200. In an example, the method 300 may include checking by what distance the element (e.g., base 204) has been moved. The method 300 may use that information to determine if proximity analysis needs to be re-performed, e.g., according to whether the adjusted distance meets or exceeds a threshold.

For qualitative displays, the threshold limit may be any suitable value, such as, for example, between about 0.1 m and about 100 m. In one illustrative example, the threshold may be about 1 m. Continuing with this example, the calculated, current distance between a subject base 204 and an offset base 214 that is of interest may be 0.5 meter. If the base 204 is moved by 0.01 m (i.e., less than the difference between the calculated distance and the threshold distance), the distance between the base 204 and the offset base 214 of interest may be assumed to still fall under the threshold. In such case, the method 300 may refrain from undertaking an additional computation to determine if the distance between the bases is sufficiently close; it may be assumed. Accordingly, the method 300 may display, qualitatively, that the bases 204, 214 are still close enough to be "of interest," problematic, within range, etc. In a quantitative display, by request, etc., re-computation of the distances may be performed. Such change-based calculations may be readily employed for other types of adjusted elements, e.g., features 208 and/or the offset well 212.

Further, one or more aspects of the method 300 may proceed in "real time." As the term is used herein, "real time" means that the output of the process occurs rapidly after the input, for example, such that it appears instantaneous or nearly instantaneous to a user. By employing parallelism and reducing the number of calculations using the method(s) 100, 300 described herein, such real-time manipulation and display of the subject well 202 in the well plan may be made available. Thus, for example, in FIG. 3, the method 300 may display the well 202 and the adjustments thereto in real time with the reception of the input, as at 310, while performing the proximity analysis concurrently therewith.

Figure 4:
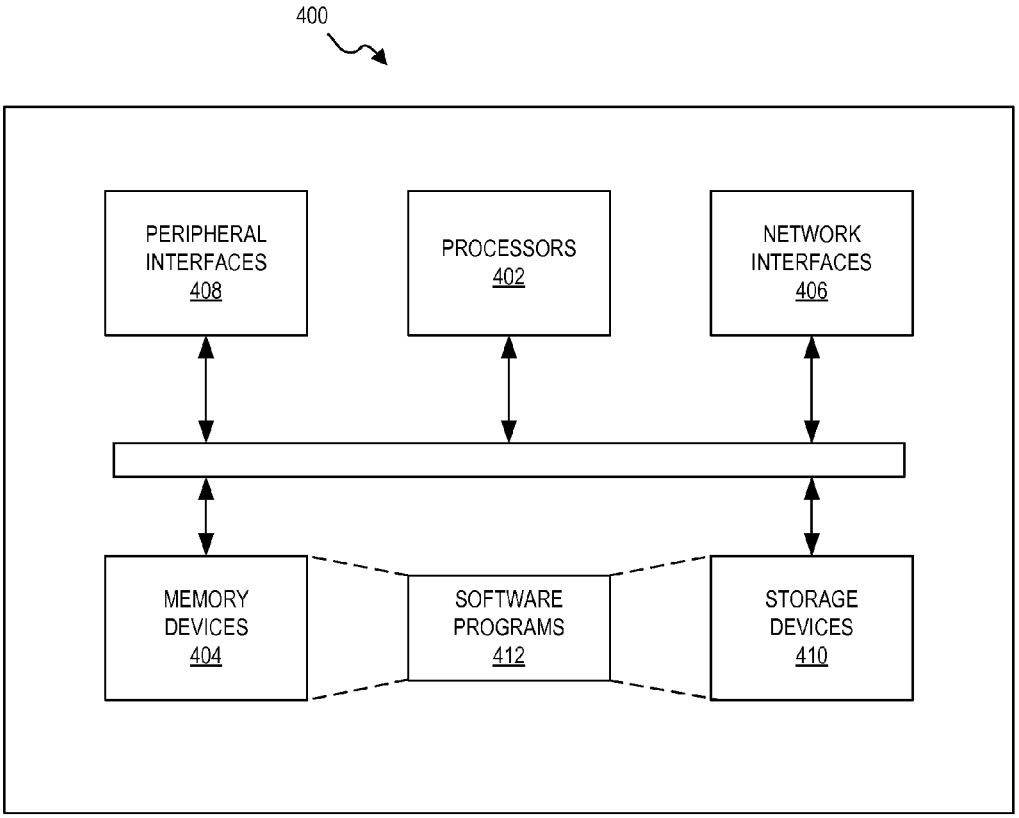
FIG. 4 illustrates a schematic view of a computing system, according to an embodiment.

Embodiments of the disclosure may also include one or more systems for implementing one or more embodiments of the method 100 and/or 300 of the present disclosure. FIG. 4 illustrates a schematic view of such a computing or processor system 400, according to an embodiment. The processor system 400 may include one or more processors 402 of varying core (including multiple cores) configurations and clock frequencies. The one or more processors 402 may be operable to execute instructions, apply logic, etc. It will be appreciated that these functions may be provided by multiple processors or multiple cores on a single chip operating in parallel and/or communicably linked together.

The processor system 400 may also include a memory system, which may be or include one or more memory devices and/or computer-readable media 404 of varying physical dimensions, accessibility, storage capacities, etc. such as flash drives, hard drives, disks, random access memory, etc., for storing data, such as images, files, and program instructions for execution by the processor 402. In an embodiment, the computer-readable media 404 may store instructions that, when executed by the processor 402, are configured to cause the processor system 400 to perform operations. For example, execution of such instructions may cause the processor system 400 to implement one or more portions and/or embodiments of the method 100 and/or any of the processes described above.

The processor system 400 may also include one or more network interfaces 406. The network interfaces 406 may include any hardware, applications, and/or other software. Accordingly, the network interfaces 406 may include Ethernet adapters, wireless transceivers, PCI interfaces, and/or serial network components, for communicating over wired or wireless media using protocols, such as Ethernet, wireless Ethernet, etc.

The processor system 400 may further include one or more peripheral interfaces 408, for communication with a display screen, projector, keyboards, mice, touchpads, sensors, other types of input and/or output peripherals, and/or the like. In some implementations, the components of processor system 400 need not be enclosed within a single enclosure or even located in close proximity to one another, but in other implementations, the components and/or others may be provided in a single enclosure.

The memory device 404 may be physically or logically arranged or configured to store data on one or more storage devices 410. The storage device 410 may include one or more file systems or databases in any suitable format. The storage device 410 may also include one or more software programs 412, which may contain interpretable or executable instructions for performing one or more of the disclosed processes. When requested by the processor 402, one or more of the software programs 412, or a portion thereof, may be loaded from the storage devices 410 to the memory devices 404 for execution by the processor 402.

Those skilled in the art will appreciate that the above-described componentry is merely one example of a hardware configuration, as the processor system 400 may include any type of hardware components, including any necessary accompanying firmware or software, for performing the disclosed implementations. The processor system 400 may also be implemented in part or in whole by electronic circuit components or processors, such as application-specific integrated circuits (ASICs) or field-programmable gate arrays (FPGAs).

The foregoing description of the present disclosure, along with its associated embodiments and examples, has been presented for purposes of illustration only. It is not exhaustive and does not limit the present disclosure to the precise form disclosed. Those skilled in the art will appreciate from the foregoing description that modifications and variations are possible in light of the above teachings or may be acquired from practicing the disclosed embodiments.

For example, the same techniques described herein with reference to the processor system 400 may be used to execute programs according to instructions received from another program or from another processor system altogether. Similarly, commands may be received, executed, and their output returned entirely within the processing and/or memory of the processor system 400. Accordingly, neither a visual interface command terminal nor any terminal at all is strictly necessary for performing the described embodiments.

Likewise, the steps described need not be performed in the same sequence discussed or with the same degree of separation. Various steps may be omitted, repeated, combined, or divided, as necessary to achieve the same or similar objectives or enhancements. Accordingly, the present disclosure is not limited to the above-described embodiments, but instead is defined by the appended claims in light of their full scope of equivalents. Further, in the above description and in the below claims, unless specified otherwise, the term "execute" and its variants are to be interpreted as pertaining to any operation of program code or instructions on a device, whether compiled, interpreted, or run using other techniques.

What is claimed is:

1. A method for planning a well, comprising:

defining the well in a representation of a domain;

identifying an offset well in the domain that is within a threshold distance of the well;

deconstructing the offset well into a plurality of offset bases;

determining, using a processor, that a first offset base of the plurality of offset bases is within the threshold distance of the well;

determining, using the processor, that a second offset base of the plurality of offset bases is not within the threshold distance of the well; and performing a proximity computation for the well with respect to the first offset base but not the second offset base.

2. The method of claim 1, wherein:

the well comprises a plurality of subject bases;

determining that the first offset base is within the threshold distance of the well comprises:

determining that the first offset base is within the threshold distance of a first subject base of the plurality of subject bases; and determining that the first offset base is not within the threshold distance of a second subject base of the plurality of subject bases.

3. The method of claim 2, wherein performing the proximity computation comprises performing the proximity computation as between the first subject base and the first offset base, but not between the second subject base and the first offset base.

4. The method of claim 1, further comprising:

receiving an input indicating an adjustment to an element of the domain, wherein the element is related to is at least one of: a geological feature, or the offset well; and adjusting the element based on the input;

determining that adjusting the element results in at least one of the geological feature or at least one of the plurality of offset bases requires performing a proximity computation for a subject base of a plurality of subject bases that define the well; and performing the proximity computation for the at least one of the geological feature or the subject base after adjusting the element.

5. The method of claim 1, further comprising:

receiving an input indicating an adjustment to a first subject base of a plurality of subject bases defining the well;

adjusting the first subject base in response to receiving the input;

performing a proximity computation for first subject base and the first offset base after adjusting the first subject base; and refraining from performing a proximity computation for the first subject base and the second offset base after adjusting the first subject base.

6. The method of claim 5, wherein the input comprises selecting the first subject base and moving the first subject base to a new location.

7. The method of claim 5, further comprising:

determining that a second subject base of the plurality of subject bases is within a threshold distance of the second offset base;

adjusting the second subject base in response to receiving the input; and performing the proximity computation for the second subject base and the second offset base in response to adjusting the second subject base.

8. The method of claim 7, wherein performing the proximity computation for the first subject base and the first offset base is conducted in parallel with performing the proximity for the second subject base and the second offset base.

9. The method of claim 1, wherein performing the proximity computation for the well and the first offset base comprises considering a positional uncertainty of the well, the first offset base, or both.

10. The method of claim 9, wherein considering the positional uncertainty comprises:

defining a first envelope around at least a portion of the well;

defining a second envelope around at least a portion of the first offset base; and performing the proximity computation as between the first envelope and the second envelope.

11. The method of claim 10, wherein the first envelope is offset from the at least a portion of the well based on an uncertainty of a position of the at least a portion of the well.

12. The method of claim 10, wherein the first envelope conforms to a shape of the at least a portion of the well, or the second envelope conforms to a shape of the at least a portion of the first offset base, or the first envelope conforms to a shape of the at least a portion of the well, and the second envelope conforms to a shape of the at least a portion of the first offset base.

13. A computing system, comprising:

one or more processors; and a memory system coupled with the one or more processors and comprising at least one computer-readable media storing instructions that, when executed by at least one of the one or more processors, cause the computing system to perform operations, the operations comprising:

identifying an offset well as requiring performing a proximity computation for a subject well based on a distance between the offset well and the subject well;

decomposing the offset well into a plurality of offset bases;

determining that a subset of the plurality of offset bases requires performing a proximity computation for the subject well based on a distance between each of the plurality of offset bases and the subject well; and performing a proximity computation for the subset of the plurality of offset bases and the subject well.

14. The system of claim 13, wherein the operations further comprise:

defining a first envelope around at least a portion of the plurality of bases of the subset, the first envelope being related to a positional uncertainty of the offset well; and defining a second envelope around at least a portion of the subject well, the second envelope being related to a positional uncertainty of the subject well, wherein determining that the subset of the plurality of offset bases are of interest to the subject well comprises determining a distance between the first and second envelopes.

15. The system of claim 13, wherein the subject well comprises a plurality of subject bases, and wherein determining that the subset of the plurality of offset bases requires performing a proximity computation for the subject well comprises:

determining that each of the plurality of offset bases of the subset are less than a threshold distance from at least one of the plurality of subject bases.

16. The system of claim 15, wherein a distance between at least one of the plurality of subject bases and at least one of the subset of the plurality of offset bases is calculated in parallel with calculating a distance between at least another one of the plurality of subject bases and at least one of the plurality of offset bases of the subset.

17. A non-transitory computer-readable medium storing instructions that, when executed by one or more processors, cause the processor to perform operations, the operations comprising:

defining a well in a representation of a domain;

identifying an offset well in the domain that is within a threshold distance of the well;

deconstructing the offset well into a plurality of offset bases;

determining that a first offset base of the plurality of offset bases is within the threshold distance of the well;

determining that a second offset base of the plurality of offset bases is not within the threshold distance of the well; and performing a proximity computation for the well with respect to the first offset base but not the second offset base.

18. The medium of claim 17, wherein:

the well comprises a plurality of subject bases; and determining that the first offset base is within the threshold distance of the well comprises:

determining that the first offset base is within the threshold distance of a first subject base of the plurality of subject bases; and determining that the first offset base is not within the threshold distance of a second subject base of the plurality of subject bases.

19. The medium of claim 18, wherein performing the proximity computation comprises performing the proximity computation as between the first subject base and the first offset base, but not between the second subject base and the first offset base.

20. The medium of claim 17, wherein performing the proximity computation for the well and the first offset base comprises considering a positional uncertainty of the well, the first offset base, or both, considering the positional uncertainty comprising:

defining a first envelope around at least a portion of the well;

defining a second envelope around at least a portion of the first offset base; and performing the proximity computation as between the first envelope and the second envelope.

* * * * *